United States Patent [19]

Burkel et al.

[11] Patent Number: 4,489,690

[45] Date of Patent: Dec. 25, 1984

[54] APPARATUS FOR OPTIMIZING OPERATING CHARACTERISTICS OF AN INTERNAL COMBUSTION ENGINE

[75] Inventors: Rainer Burkel, Le Chesnay; Cornelius Peter, Paris, both of France

[73] Assignee: Robert Bosch GmbH, Stuttgart, Fed. Rep. of Germany

[21] Appl. No.: 434,297

[22] Filed: Oct. 14, 1982

Related U.S. Application Data

[63] Continuation of Ser. No. 187,128, Sep. 15, 1980, abandoned.

[30] Foreign Application Priority Data

Oct. 17, 1979 [DE] Fed. Rep. of Germany ..... 2941977

[51] Int. Cl.[3] ..... F02P 5/04; F02M 51/00

[52] U.S. Cl. ..... 123/419; 123/436

[58] Field of Search ..... 123/435, 436, 415, 416, 123/425, 478, 419

[56] References Cited

U.S. PATENT DOCUMENTS

| | | | |
|---|---|---|---|
| 2,628,606 | 1/1953 | Draper et al. | 123/436 X |
| 3,142,967 | 8/1964 | Schweitzer | 60/39.28 R |
| 3,596,643 | 8/1971 | Schweitzer | 123/419 |
| 4,026,251 | 5/1977 | Schweitzer et al. | 123/419 X |
| 4,064,846 | 12/1977 | Latsch et al. | 123/436 |
| 4,098,244 | 7/1978 | Sumiyoshi et al. | 123/415 |
| 4,130,863 | 12/1978 | Schweitzer et al. | 123/487 X |
| 4,166,440 | 9/1979 | Helava et al. | 123/416 |
| 4,197,767 | 4/1980 | Leung | 123/436 X |
| 4,232,643 | 11/1980 | Leshner et al. | 123/436 |
| 4,261,315 | 4/1981 | Geiger et al. | 123/435 X |
| 4,306,284 | 12/1981 | Malcolm | 123/487 X |

*Primary Examiner*—Tony M. Argenbright

*Attorney, Agent, or Firm*—Edwin E. Greigg

[57] ABSTRACT

An apparatus for optimizing operating characteristics of an internal combustion engine on the basis of torque variations based on a test signal, wherein the maximum output torque is determined directly on the basis of the torque signal and the specific fuel consumption is determined indirectly from the torque signal via the efficiency. Either the maximum output torque or the minimum fuel consumption is optimized, depending on the engine load range. Additional apparatus is described for simultaneously optimizing the ignition angle on the basis of torque signals, wherein individual test signals are associated only with individual cylinders or groups of cylinders and the corresponding torque variations relating to the individual cylinders are ascertained and processed.

1 Claim, 4 Drawing Figures

APPARATUS FOR OPTIMIZING OPERATING CHARACTERISTICS OF AN INTERNAL COMBUSTION ENGINE

This is a continuation of application Ser. No. 187,128, filed Sept. 15, 1980, now abandoned.

BACKGROUND OF THE INVENTION

The invention relates to an apparatus for controlling the operation of an internal combustion engine so as to provide maximum power or minimum fuel consumption for the prevailing operational conditions.

In a known apparatus described in U.S. Pat. No. 4,064,846, issued Dec. 27, 1977 to Latsch et al, the fuel metering is optimized, depending upon the load status, to maximum output or minimum fuel consumption. The optimizing makes use of the information given in the performance graph as parameters, specifically the fuel consumption per unit of time plotted over the aspirated air quantity per unit of time at a constant rpm. At a constant air quantity and with a variation of the fuel quantity, the output torque can be optimized, while the operational point of minimum specific fuel consumption can be determined by means of a variation of the air quantity (by means of a bypass, for instance) and with a constant fuel quantity.

Thus in the known optimizing apparatus it is required that either the fuel quantity or the air quantity must be varied, depending upon the variable to be optimized.

This involves significant expense, which, especially in the case of mass production of optimizing systems, appears to be insupportably high.

OBJECT AND SUMMARY OF THE INVENTION

It is accordingly the object of the invention to propose an optimizing system for either maximum output torque or minimum specific fuel consumption for an internal combustion engine which requires as few adjustment members as possible and is also both favorable in cost and reliable over long-term operation.

The primary advantage of the proposed apparatus for optimizing operating characteristics of an internal combustion engine described herein is that in comparison with the known optimizing systems, intended for optimizing the same variables, fewer adjustment members are required to produce a test signal, and the entire system thus becomes more favorable in cost and more reliable.

In the optimizing apparatus described herein, test signals are used to modulate a fuel metering signal, that is, to provide periodic alterations of this fuel metering signal. Fuel is supplied to the engine in accordance with this modulated fuel metering signal by a fuel metering device. A torque measurement device generates a torque signal indicating the engine output torque. This torque signal is used to adjust the fuel metering signal to operate the engine at either maximum output torque or minimum specific fuel consumption for the prevailing operational conditions, depending on the engine load range.

The torque signal and the test signals are supplied to a first control circuit, which correlates periodic alterations of the torque signal with the test signals causing these alterations, and produces output signals indicating the magnitude and phase of the periodic alterations of the torque signal relative to the corresponding causitive test signals. When the engine is operating at maximum output torque, the periodic alterations of the torque signal resulting from the test signals will be minimal; at other operating conditions, the magnitude and phase of the periodic alterations of the torque signal relative to the corresponding tests signals will be proportional to the deviation and direction of deviation, respectively, of the metered fuel quantity from that required to operate the engine at maximum output torque for the prevailing operational conditions.

When the engine is operating in a first load range, the output signals of the first control circuit is supplied through a switching device to a regulating circuit, which adjusts the fuel metering signal to operate the engine at its maximum output torque.

The torque signal and the modulated fuel metering signal are also supplied to a divider circuit which divides the torque signal by the modulated fuel metering signal to produce an output signal proportional to the engine efficiency. This engine efficiency signal and the test signals are supplied to a second control circuit which correlates periodic alterations of the engine efficiency signal with the test signals causing these alterations, and produces output signals indicating the magnitude and phase of the periodic alterations of the engine efficiency signal relative to the corresponding test signals. When the engine is operating at maximum efficiency, the periodic alterations of the engine efficiency signal resulting from the test signals will be minimal; at other operating conditions, the magnitude and phase of the periodic alterations of the engine efficiency signal relative to the corresponding test signals will be proportional to the deviation and direction of deviation, respectively, of the metered fuel quantity from that required to operate the engine at maximum efficiency for the prevailing operating conditions.

When the engine is operating in a second load range, the output signals of the second control circuit are supplied through the switching device of the regulating circuit, which adjusts the fuel metering signal of operate the engine at maximum efficiency, and thus at minimum specific fuel consumption.

The switching device is controlled by an engine load status recognition circuit, which connects the regulating circuit to receive the output signals of either the first or second control circuit, depending on the engine load range.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
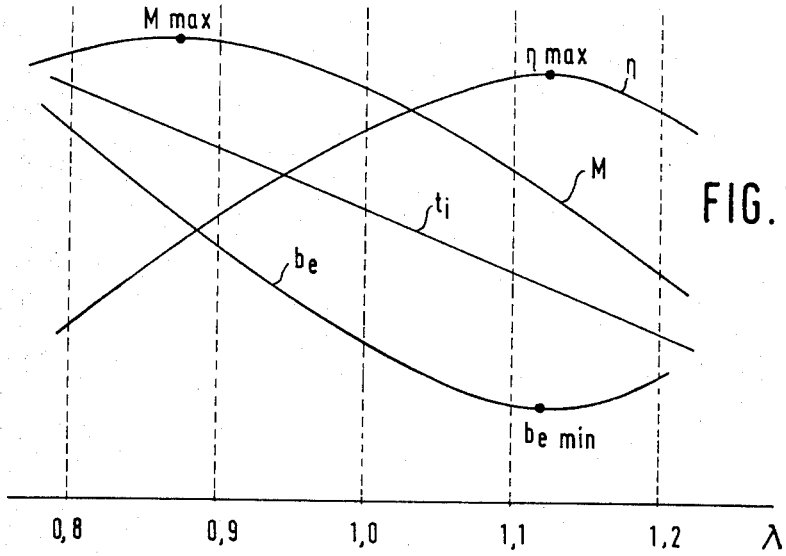
FIG. 1 is a diagram showing curves for the torque, the injection time, the specific fuel consumption and the efficiency, plotted over the air number lambda.

FIG. 1 shows in qualitative fashion the interrelationships which are important for a particular operational point of an internal combustion engine. The symbols used are as follows: lambda=air number; $t_i$=injection time in the case of a metering system which is an injection-type system; M=torque of the engine; $\eta$=engine efficiency; $b_e$=specific fuel consumption; mL=aspirated air quantity per unit of time; n=rpm and $\alpha_z$=ignition angle. The curves illustrate the generally known interrelationships, that is, that the maximum torque appears at lambda<1 and the minimum specific fuel consumption appears at lambda>1. The simplest means of determining the maximum torque and minimum consumption is to measure the different variables, although measuring the specific fuel consumption is relatively expensive to attain.

In the case of electronically controlled injection systems, however, the specific fuel consumption can also be ascertained on the basis of the torque measurement. The specific fuel consumption of one cylinder, per cycle (that is, two revolutions in the case of a 4-stroke engine), is:

specific fuel consumption=fuel quantity divided by (torque output×time)

$$be = \frac{K1 \cdot ti}{(M \cdot \omega) \cdot \left(\frac{2}{\omega}\right)} = K2 \cdot \frac{ti}{M}$$

A similar observation produces the following relationship for the efficiency of the engine:

$$\eta = K3 \cdot \frac{M}{ti}$$

This means that the maximum efficiency and the minimum fuel consumption appear at the same lambda value, and it is the fundamental concept of the invention to determine both the maximum output and the minimum consumption on the basis of the single value for torque variation. The intention is furthermore, because of the determination of maximum efficiency, to omit a direct calculation of the minimum consumption, so that the optimizing will take place exclusively with a maximum-value determination.

Although the exemplary embodiments pertain to a fuel injection system, the invention is not restricted to closed-loop optimal-value control in such injection systems. What is essential is solely the precise ascertainment of the metered fuel in view of the calculation process.

It the case of closed-loop optimal-value control, the closed-loop control apparatus must be able to recognize whether the particular operational point in question is located in an upwardly sloping or a downwardly sloping portion of the particular curve. This can be attained by way of a scanning-ratio recognition procedure with a clocked trigger signal or a clocked test signal, and this recognition procedure will now be explained with the aid of FIG. 2.

Figure 2:
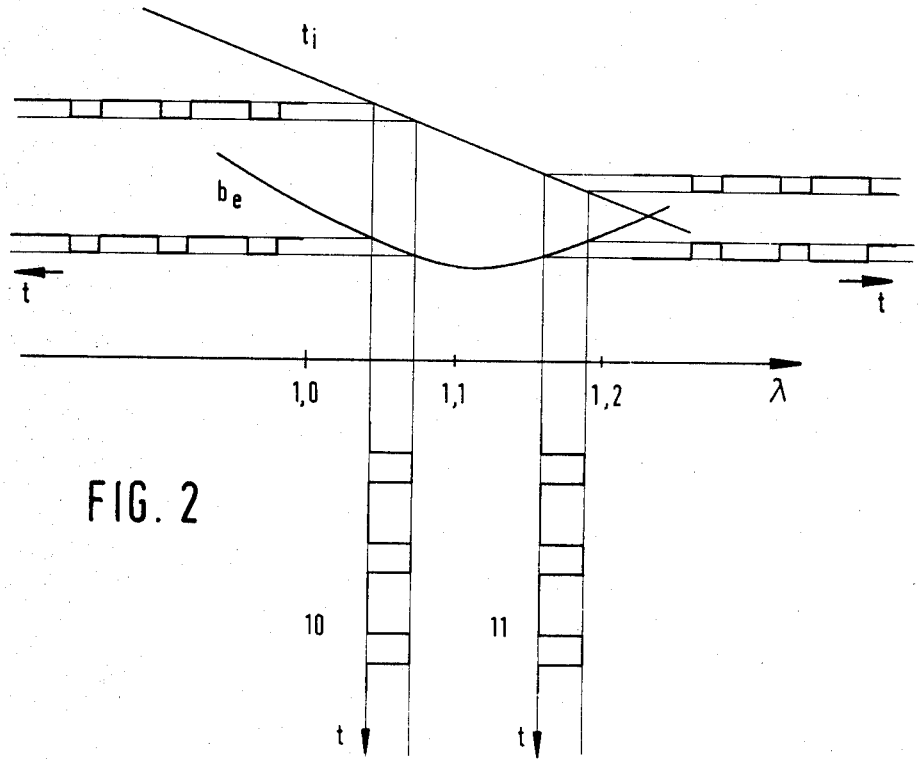
FIG. 2 is a diagram explaining the principle of the optimizing, which is known in itself.

FIG. 2 shows a detail of the curves given in FIG. 1, with only the injection time $t_i$ and the specific fuel consumption $b_e$ being plotted over lambda values. "Test signals" 10 and 11 at different lambda values represent a mixture composition which varies over the course of time. One test signal is plotted at either side of the minimum consumption, and the replication of these test signals at the curve for specific fuel consumption shows different scanning ratios. Thus, by ascertaining the phase of the scanning ratio with respect to the appropriate test signal, it can be determined whether the metered fuel quantity with respect to the minimum consumption value is too high or too low.

Figure 3:
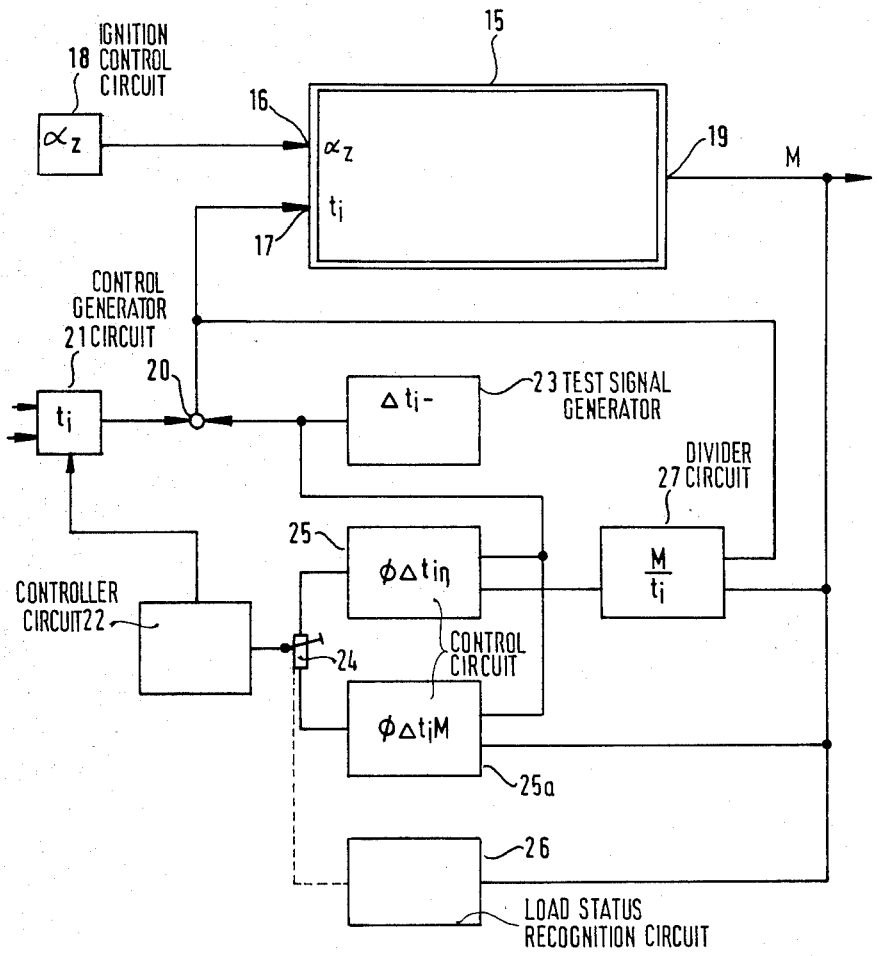
FIG. 3 shows a first exemplary embodiment of an apparatus for optimizing the output and specific fuel consumption.

FIG. 3 shows a first exemplary embodiment, in the form of a block diagram, for an injection system whose extreme values are controlled in closed-loop fashion. The engine is shown as a simple block 15, which receives an ignition signal via an input 16 and an injection signal via an input 17 in the form of electrical input signals. The input 16 is connected directly to an ignition control device 18. On the output side, a torque signal can be picked up from the engine 15 at an output 19.

A summation point 20 precedes input 17 and receives an injection control signal from a control generator 21 as well as a test signal from a test signal generator 23. A closed-loop controller 22 communicates on the output side with the control generator 21 and on the input side with the slide of a potentiometer 24, whose two input terminals are linked respectively with control stages 25 and **25*a* for determining correlative values for the torque and for the efficiency, respectively. The position of the slide of the potentiometer 24 depends on the output signal of a load status recognition stage 26. While inputs of the two stages 25*a* and 26 are directly coupled with the torque output 19 of the engine 15, the control stage 25 for determining the efficiency $\eta$ is preceded by a divider stage 27, which in turn receives a torque signal from the output 19 and an injection signal from the summation point 20. Further input signals of the two control stages 25 and 25*a* come from the test signal generator 23**.

As shown in the block diagram of FIG. 3, the engine 15 receives both an injection signal from the timing element 21 and a test signal from the test signal generator 23. Depending on the load status of the engine, the closed-loop controller 22 receives a value from one of the control stages **25*a* and 25**, in order to determine either the maximum output or the minimum consumption. The minimum consumption is determined by way of the maximum efficiency.

The two control stages 25 and **25*a*** generate signals according to the formula:

$$\phi_i = \phi_{i-1} + \frac{1}{NK+1}\left[\Delta M \cdot \text{sign}(\Delta ti) - \phi_{i-1}\right]$$

(1). $\Delta M$ represents the difference in the output torque signal M resulting from the test signal.

(2). The formula above describes a kind of short-time correlation, wherein the term NK represents the correlation length. That means a small number chosen for NK will provide bad filtering but fast reaction and otherwise a big number NK will provide good filtering but poor dynamic reaction of the closed loop.

The algebraic sign of the signal indicates the direction of the control deviation (instantaneous $t_i$−optimal $t_i$) and the amount indicates the magnitude of this control deviation. If the correlative value $\phi$=zero, then the instantaneous $t_i$=the optimal $t_i$. The controller 22, which functions integrally, adjusts the injection duration $t_i$ until the optimal value for that particular occasion has been attained.

The primary advantage of the potentiometer apparatus 24 is the gradual switchover between the two optimal-value control procedures to maximum output or minimum specific fuel consumption (that is, maximum efficiency).

The type of torque measurement which is selected depends upon many factors. For instance, the determination may be made directly via a torque transducer, or it can be made via the measurement of the combustion chamber pressure and the ascertainment of the indexed work performed. The rotational behavior of the crankshaft can also furnish information as to the amount of torque produced.

The simultaneous closed-loop control of the optimal ignition angle $\alpha_z$ and of the fuel metering signal (in this case, the injection duration $t_i$) is possible in principle. Because the system has only one output variable, namely the torque M, it is not possible to make a distinction with the one output variable given simultaneous modulation of the ignition angle and of the fuel metering.

One way out of this dilemma is provided by associating the two test signals with different cylinders; however, it is then necessary to recognize the torque for each cylinder. A block diagram of an optimizing system which includes such a provision is given in FIG. 4.

Figure 4:
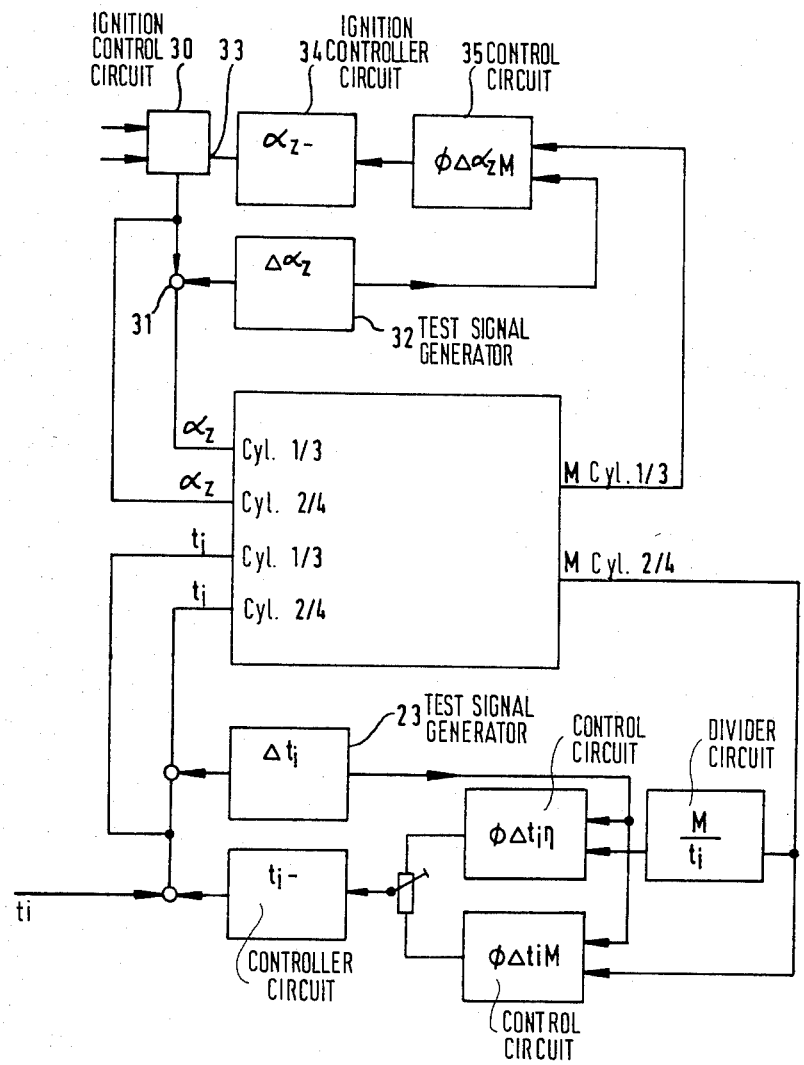
FIG. 4 shows a second exemplary embodiment of the optimizing apparatus, where the instant of ignition for an internal combustion engine is optimized as well.

In FIG. 4, the optimizing system for the operational characteristics of instant of ignition and fuel metering includes two completely separate optimizing circuits, with the individual circuits being associated with different cylinders of the engine. Thus, the cylinders 1 and 3, for example, are utilized for controlling the extreme value of the instant of ignition, and cylinders 2 and 4 are utilized for controlling the extreme values of the metering signal. The portion of the subject of FIG. 4 which is responsible for optimizing the injection time corresponds generally with the apparatus of FIG. 3, although the given torque of only cylinders 2 and 4 is observed in this case. Furthermore, only the two cylinders 2 and 4 here obtain injection values provided with test signals, in a manner corresponding to what has been described above, while the other two cylinders 1 and 3 receive injection values which have not been influenced by the test signal generator 23.

The optimizing system for the instant of ignition includes the ignition control stage 30, whose output signal is switchable, first, directly to the spark plugs associated with cylinders 2 and 4 and, second, indirectly to the spark plugs of cylinders 1 and 3 via a summation point 31. The summation point 31 receives as a second signal the output signal of the test signal generator 32 for the ignition. An input 33 of the ignition control stage 30 is coupled via an ignition controller 34 with the control stage 35, in which a correlative value is formed pertaining to the ignition signal. Input signals of this control stage 35 are, first, a signal of the test signal generator 32 and, second, a torque signal from the cylinders 1 and 3.

As has been demonstrated, the optimizing systems described above function in an extremely simple fashion, so long as the particular torque determination is functioning correctly. The primary reason for the simplicity of the optimizing system for maximum output or minimum fuel consumption is the advantage that, because of the determination of the minimum fuel consumption via the maximum efficiency, different transducers can be done away with and it is possible to function only with curves whose courses are of the same type; as a result, a reversal of the direction of closed-loop control is not necessary.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for optimizing operating characteristics of an internal combustion engine having a plurality of operating cylinders, each supplied with an operating mixture of fuel and air and having a spark plug for igniting the mixture, which comprises:

means for generating a fuel quantity injection signal for each engine cylinder;

ignition control means for supplying ignition timing signals to each cylinder spark plug, to determine the moment of ignition in each cylinder;

first test signal generating means for generating predetermined first test signals;

first modulator means for modulating the fuel quantity injection signal for only at least one first cylinder in accordance with the first test signals, the only at least one first cylinder constituting a portion of the plurality of engine cylinders;

first torque measurement means for generating a first torque signal indicating output torque of the at least one first cylinder;

maximum torque determining means for determining the maximum output torque operating characteristic of the engine on the basis of variations in the first test signal resulting from the modulation of the fuel quantity injection signal for the at least one first cylinder and evaluation of the first torque signal;

minimum fuel consumption determining means for determining the minimum specific fuel consumption operating condition of the engine on the basis of variations in the first test signal resulting from the modulation of the fuel quantity injection signal for the at least one first cylinder and evaluation of an efficiency signal from a divider means for dividing the torque signal by the modulated fuel quantity injection signal; and second test signal generating means for generating predetermined second test signals;

second modulator means for modulating the ignition timing signals supplied to only at least one second cylinder in accordance with the second test signals, to vary the moment of ignition of the only at least one second cylinder, which constitutes another portion of the plurality of engine cylinders;

second torque measurement means for generating a second torque signal indicating output of the at least one second cylinder;

control circuit means, connected to receive the second test signals and the second torque signal, for determining ignition signal values corresponding to the maximum output torque operating characteristic of the engine on the basis of variations in the second test signal resulting from the modulation of the ignition timing signals supplied to the at least one second cylinder; and ignition signal controller means, for adjusting the ignition timing signals to optimize the maximum output torque operating characteristic of the engine.

* * * * *